US006016410A

United States Patent [19]

Aslam et al.

[11] Patent Number: 6,016,410

[45] Date of Patent: Jan. 18, 2000

[54] FUSER FOR REPRODUCTION APPARATUS WITH MINIMIZED TEMPERATURE DROOP

[75] Inventors: Muhammed Aslam; Fangsheng Wu, both of Rochester; Robert D. Bobo, Ontario, all of N.Y.

[73] Assignee: Eastman Kodak Company, Rochester, N.Y.

[21] Appl. No.: 09/197,365

[22] Filed: Nov. 20, 1998

[51] Int. Cl.[7] ..... G03G 15/20

[52] U.S. Cl. ..... 399/69; 34/428; 219/216; 399/70

[58] Field of Search ..... 399/67, 69, 70, 399/328, 330; 219/216, 469; 432/60; 118/60; 34/428

[56] References Cited

U.S. PATENT DOCUMENTS

| | | | |
|---|---|---|---|
| 4,671,643 | 6/1987 | Shigemura et al. | 399/70 |
| 5,307,132 | 4/1994 | Tsuchiya | 399/70 |

*Primary Examiner*—William Royer
*Assistant Examiner*—William A. Noe
*Attorney, Agent, or Firm*—Lawrence P. Kessler

[57] ABSTRACT

A fuser, for a reproduction apparatus, having at least one heated fuser roller operating at a setpoint temperature to permanently fix a marking particle image to a receiver member, and a mechanism for controlling temperature droop in the at least one heated fuser roller. The temperature droop controlling mechanism includes an external heat source movable to a position in operative relation with the heated fuser roller and a nonoperative position remote from the heated fuser roller. A logic and control unit regulates heat input to the heated fuser roller, during an idle period, to raise the setpoint temperature for the heated fuser roller a preselected amount relative to the operating temperature set point. At the actuation of the reproduction apparatus job run start, the control unit regulates heat input to the heated fuser roller by the fuser roller heater and the external heat source to raise the fuser operating temperature setpoint a preselected amount relative to the idle temperature setpoint. After a preselected time, the control unit actuates a source of air pressure to direct air flow at the fuser roller for creating an intended thermal gradient in the heated fuser roller. Then at a preselected time later, the control unit enables the first receiver member of a reproduction job run to be transported into operative relation with the heated fuser roller, whereby there is substantially no temperature droop in the heated fuser roller. Further, the logic and control unit actuates the pressurized air source to maintains such air flow for a preselected time after the last receiver member in a reproduction job run has passed through the fuser, whereby overshoot of the fuser roller temperature is minimized.

12 Claims, 3 Drawing Sheets

FUSER FOR REPRODUCTION APPARATUS WITH MINIMIZED TEMPERATURE DROOP

CROSS-REFERENCE TO RELATED APPLICATIONS

U.S. Pat. No. 5,937,231, entitled "FUSER FOR REPRODUCTION APPARATUS WITH MINIMIZED TEMPERATURE DROOP".

U.S. Ser. No. 09/197,734, filed on Nov. 20,1998, entitled "MAXIMIZING IMAGE GLOSS UNIFORMITY BY MINIMIZING THE EFFECT OF TEMPERATURE DROOP IN A FUSER FOR REPRODUCTION APPARATUS ".

U.S. Ser. No. 09/197,686, filed on Nov. 20,1998, entitled "FUSER FOR REPRODUCTION APPARATUS WITH MINIMIZED TEMPERATURE DROOP".

FIELD OF THE INVENTION

The present invention relates in general to a fuser for a reproduction apparatus, and more particularly to a reproduction apparatus fuser which exhibits minimized temperature droop.

BACKGROUND OF THE INVENTION

In typical commercial reproduction apparatus (electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There the image is fixed to the receiver member by heat and/or pressure from the fuser apparatus to form a permanent reproduction thereon.

One type of fuser apparatus, utilized in typical reproduction apparatus, includes at least one heated roller and at least one pressure roller in nip relation with the heated roller. The fuser apparatus rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

When the reproduction apparatus is in the standby mode between job runs, the heated fuser roller will be in a substantially equilibrium condition; that is, there is at most only a small temperature gradient between the outer surface of the fuser roller and the inner core. Then when the job run begins energy (heat) is removed from the fuser roller to the copies being fused. As a result, the temperature at the outer surface of the fuser roller droops very quickly. Since the temperature droops from the operating setpoint, the logic and control for the reproduction apparatus turns on the fuser heating device. However, depending upon the thickness of the fuser roller, there is a time lag until the fuser roller surface receives enough energy to get back to the desired fusing temperature. During the time lag , the droop in surface temperature causes inferior fusing quality. When the reproduction apparatus is a process color machine, the temperature droop results in objectionable lower saturation of colors and image gloss.

To overcome fuser roller temperature droop at the start of a reproduction run, some apparatus include temperature control algorithms that raise the fuser roller temperature at the start of the run above the run temperature set point. That is, the energy input is started earlier so that the temperature droop from the setpoint is minimized. However, this causes the fuser roller temperature to be higher at the start of a job run than the desired setpoint and lower at the bottom of the temperature droop. Therefore, the copies over a job run will be fused at differing temperatures and have differing image quality appearance.

SUMMARY OF THE INVENTION

In view of the above, this invention is directed to a fuser, for a reproduction apparatus, having at least one heated fuser roller operating at a setpoint temperature to permanently fix a marking particle image to a receiver member, and a mechanism for controlling temperature droop in the at least one heated fuser roller. The temperature droop controlling mechanism includes an external heat source movable to a position in operative relation with the heated fuser roller and a nonoperative position remote from the heated fuser roller. A logic and control unit regulates heat input to the heated fuser roller, during an idle period, to hold the idle temperature for the heated fuser roller a preselected amount above to the operating temperature set point. At the actuation of the reproduction apparatus job run start, the control unit regulates heat input to the heated fuser roller by the fuser roller heater and the external heat source to raise the fuser temperature a preselected amount above the idle temperature. After a preselected time, the control unit actuates a source of air pressure to direct air flow at the fuser roller for creating an intended thermal gradient in the heated fuser roller. Then at a preselected time later, the control unit enables the first receiver member of a reproduction job run to be transported into operative relation with the heated fuser roller, whereby there is substantially no temperature droop in the heated fuser roller. Further, the logic and control unit actuates the pressurized air source to maintain such air flow for a preselected time after the last receiver member in a reproduction job run has passed through the fuser, whereby overshoot of the fuser roller temperature is minimized.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
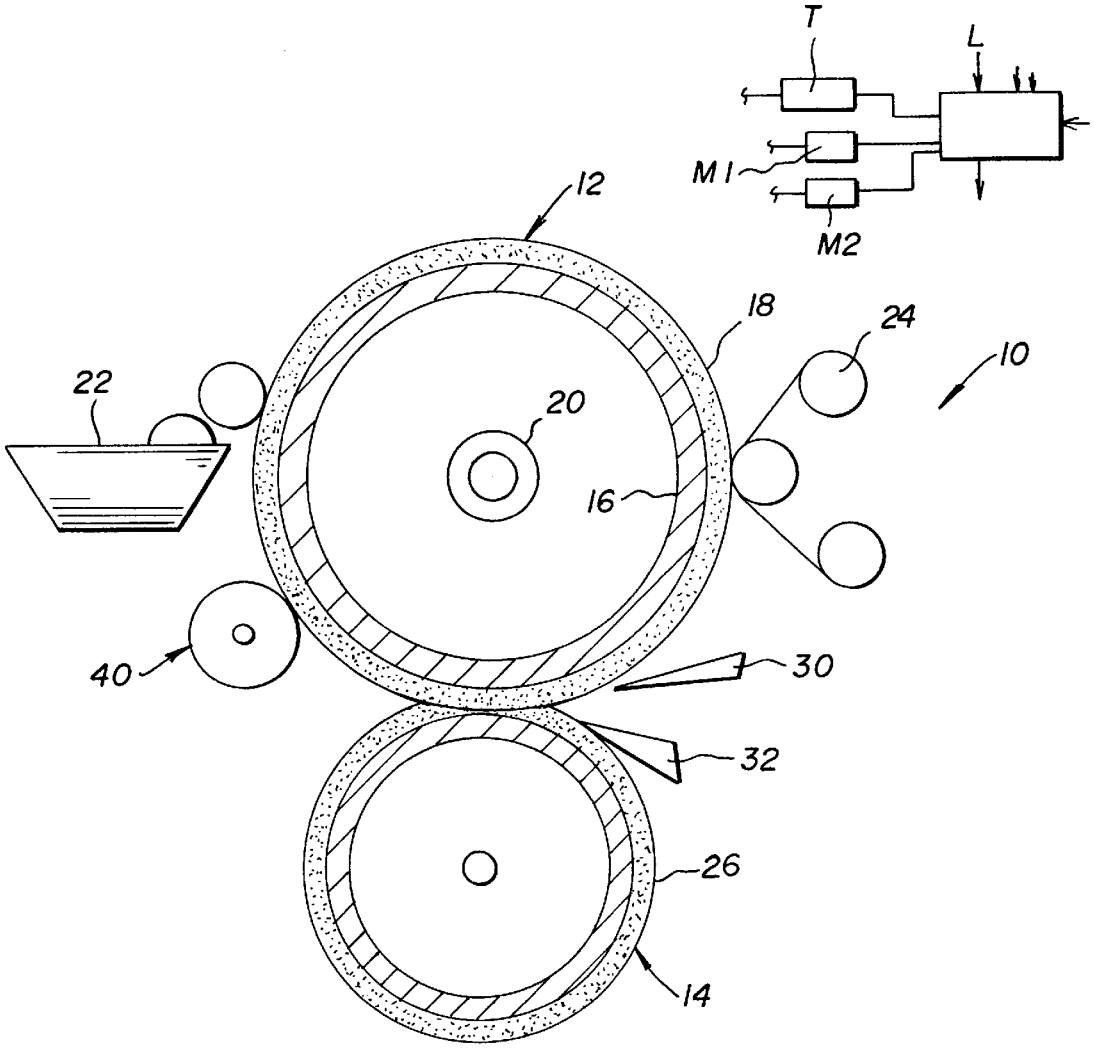
FIG. 1 is a side elevational view of a reproduction apparatus fuser, with portions removed to facilitate viewing, the fuser having a temperature droop control mechanism according to this invention.

Referring now to the accompanying drawings, a typical reproduction apparatus fuser, designated generally by the numeral 10, is shown. The fuser apparatus 10 includes a fuser roller 12 in nip relation with a pressure roller 14. Rotation of the fuser apparatus rollers by any suitable drive mechanism (such as a motor Ml designated schematically in FIG. 1) will serve to transport a receiver member bearing a marking particle image through the nip under the application of heat and pressure. The receiver member may be, for example, a sheet of plain bond paper, or transparency material. The heat will soften the marking particles and the pressure will force the particles into intimate contact and to be at least partially imbibed into the fibers at the surface of the receiver material. Thus, when the marking particles cool, they are permanently fixed to the receiver member in an image-wise fashion.

The fuser roller 12 includes a core 16 and a cylindrical fusing blanket 18 supported on the core. The blanket 18 is typically made of an elastomer material particularly formulated to be heat conductive or heat insulative dependent upon whether the fuser heat source is located within the core 16 or in juxtaposition with the periphery of the blanket. In the illustrated preferred embodiment, the heat source is an internal heater lamp designated by the numeral 20. A well known suitable oiler mechanism 22 selectively applies an oil to the blanket 18 of the fuser roller to substantially prevent offsetting of the marking particle image to the fuser roller 12. Additionally, a suitable cleaning mechanism 24 wipes the fuser roller surface to remove excess offset preventing oil and other contaminants which would degrade the quality of the image fused to the receiver member. The fuser 10 also include a mechanism 40 (more fully described in copending U.S. pat. app. Ser. No. 09/197,686,) filed on Nov. 20.1998 for selectively applying heat to the external surface of the fusing roller 12.

The pressure roller 14 has a hard outer shell 26. Typically, the shell 26 is made of metal, such as aluminum or steel for example. The shell 26 may also have a well known suitable surface coating (not shown) applied thereto to substantially prevent offsetting of the marking particle image to the pressure roller 14. Any well known suitable pressure mechanism (such as a motor $M_2$ designated schematically in FIG. 1) selectively applies a particular force to create a desired pressure in the nip to effect the fusing of the marking particle image to the receiver member travelling through the nip.

Skive mechanisms 30 and 32 are respectively associated with the fuser roller 12 and the pressure roller 14 for removing any receiver members which inadvertently adhere to the roller surfaces. The skive mechanism 30 includes a source of pressurized air in flow communication with a plurality of nozzles directed to the fuser roller 12. Downstream of the nip between the fuser roller 12 and the pressure roller 14 is a transport device (not shown) for feeding receiver members away from the nip. Further, the fuser 10 includes a cleaning mechanism 24 which engages the fusing roller 12 to clean the surface thereof.

The fuser apparatus 10 is controlled by a logic and control unit L for the reproduction apparatus. The unit L receives signals, from apparatus processing stations and receiver member location sensors about the processing path, fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

Typically, roller fuser apparatus for reproduction apparatus of the type used in high volume copier/printers applications have a temperature droop of about 30° F. to 50° F., and even higher temperature overshoot after a reproduction job run is completed. The temperature droop is a result of the inability of the fuser apparatus to accommodate the heat taken out of the fuser apparatus by receiver members. The fuser apparatus, particularly the elastomer blanket covered fuser roller has substantial thermal resistance which causes a time delay for the heat to travel from the internal heat source within the fuser core to the outside of the elastomer blanket surface.

On the other hand, temperature overshoot is due to the energy stored in the fuser roller which serves to raise the surface temperature of the elastomer blanket of the fuser roller above the fuser setpoint temperature when the reproduction job has been completed. That is, when the job run has been completed, receiver members are no longer being fused to take heat out of the fuser roller. Therefore, the fuser roller stores the heat and its temperature rises. The most significant temperature overshoot occurs after running a reproduction job comprising a large number of receiver members through the fuser apparatus, and when the temperature of the fuser roller has already recovered from the droop condition to the fuser operating setpoint temperature and the fuser roller has been stopped (is no longer rotating). The overshoot is proportional to the heat capacity of the fuser roller and the thermal gradient between the fuser core and the surface of the elastomer blanket.

Figure 2:
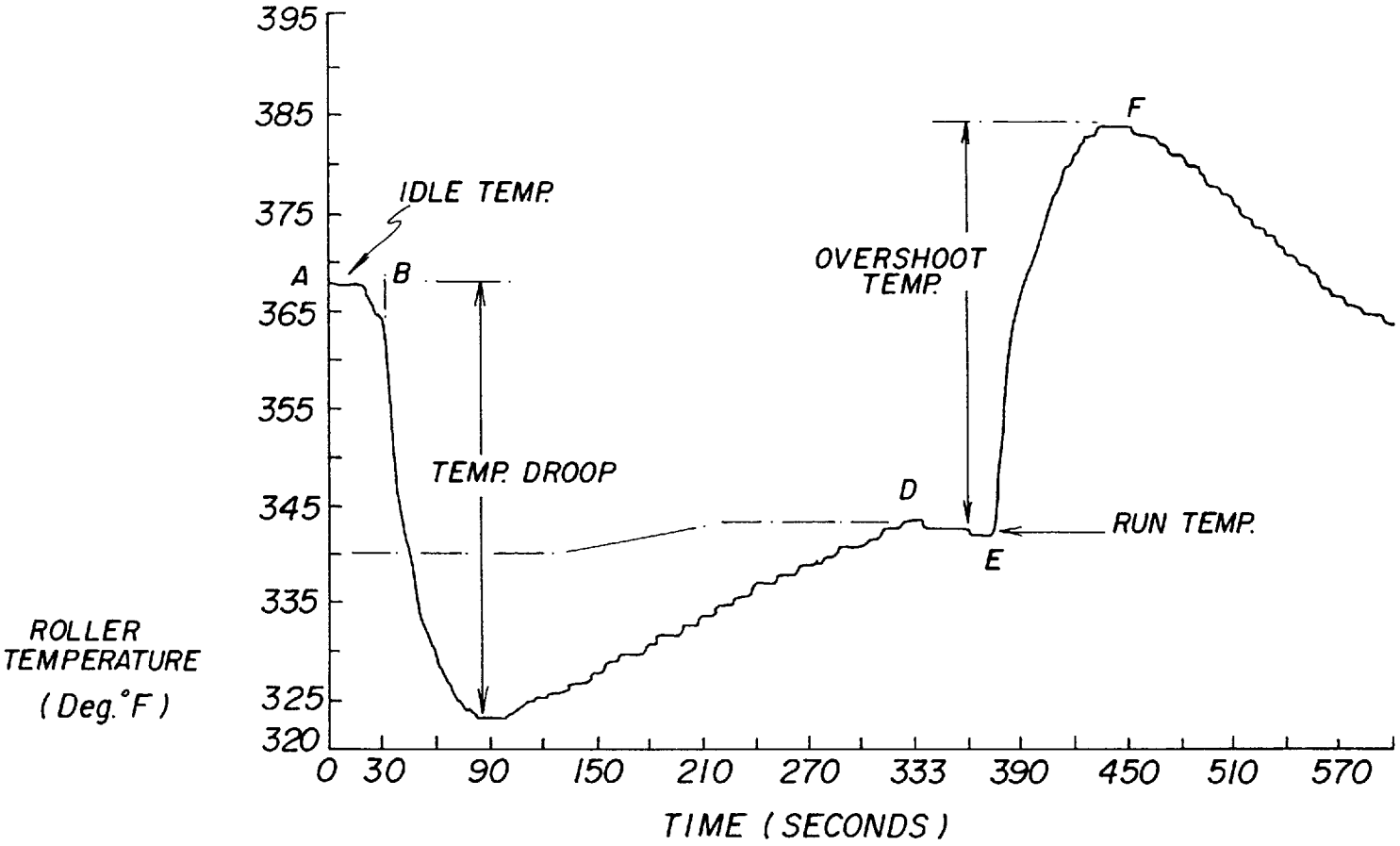
FIG. 2 is a graphical representation of typical reproduction apparatus fuser temperature responses for prior art fuser apparatus.

FIG. 2 shows a graph of typical prior art fuser apparatus temperature responses during idle, job run, and stop modes. The portion of the graph from points A to B represent the idle temperature (368° F.) for the fuser roller of the fuser apparatus. At point B the reproduction apparatus is started to run reproduction job. It can be seen that from points B to C the fuser roller surface temperature is dropping, because the fuser roller heater is unable to supply sufficient heat to compensate for the heat taken out of the fuser apparatus by the receiver members. The total droop is about 45° F. In black and white copying applications, such a temperature drop would not significantly affect the image quality, as long as image fixing is of a minimally acceptable level in that temperature droop window. However, in color applications such a temperature droop would cause a significant shift in the image gloss, which would be unpleasing to a viewer, and unacceptable to a customer. The portion from points C to D of the curve represent the temperature recovery zone from the maximum droop temperature to the operating temperature setpoint. At the point E, the reproduction job run is completed. Points E to F then represent the overshoot of the fuser roller temperature, from the operating setpoint, due to the stored energy in the fuser roller.

According to this invention, the fuser roller temperature droop for the fuser apparatus 10 is substantially eliminated by having the logic and control unit L operate to maintain the fuser roller at an idle temperature above an operating temperature, in which, when a print job is started, the fuser roller is heated to a temperature above the idle temperature; and wherein a source of pressurized air is actuated to create a thermal gradient in the fuser roller. This establishes a thermal gradient between the fuser roller core 16 and the outer surface of the elastomer blanket 18 before the first receiver member in a reproduction job run reaches the fuser nip. At the actuation of the copy start button of the reproduction apparatus, the skives 30 are turned on to supply the desired air flow and establish the thermal gradient in the fuser roller. The time to first copy may be delayed slightly to enable this temperature gradient to be established.

Figure 3:
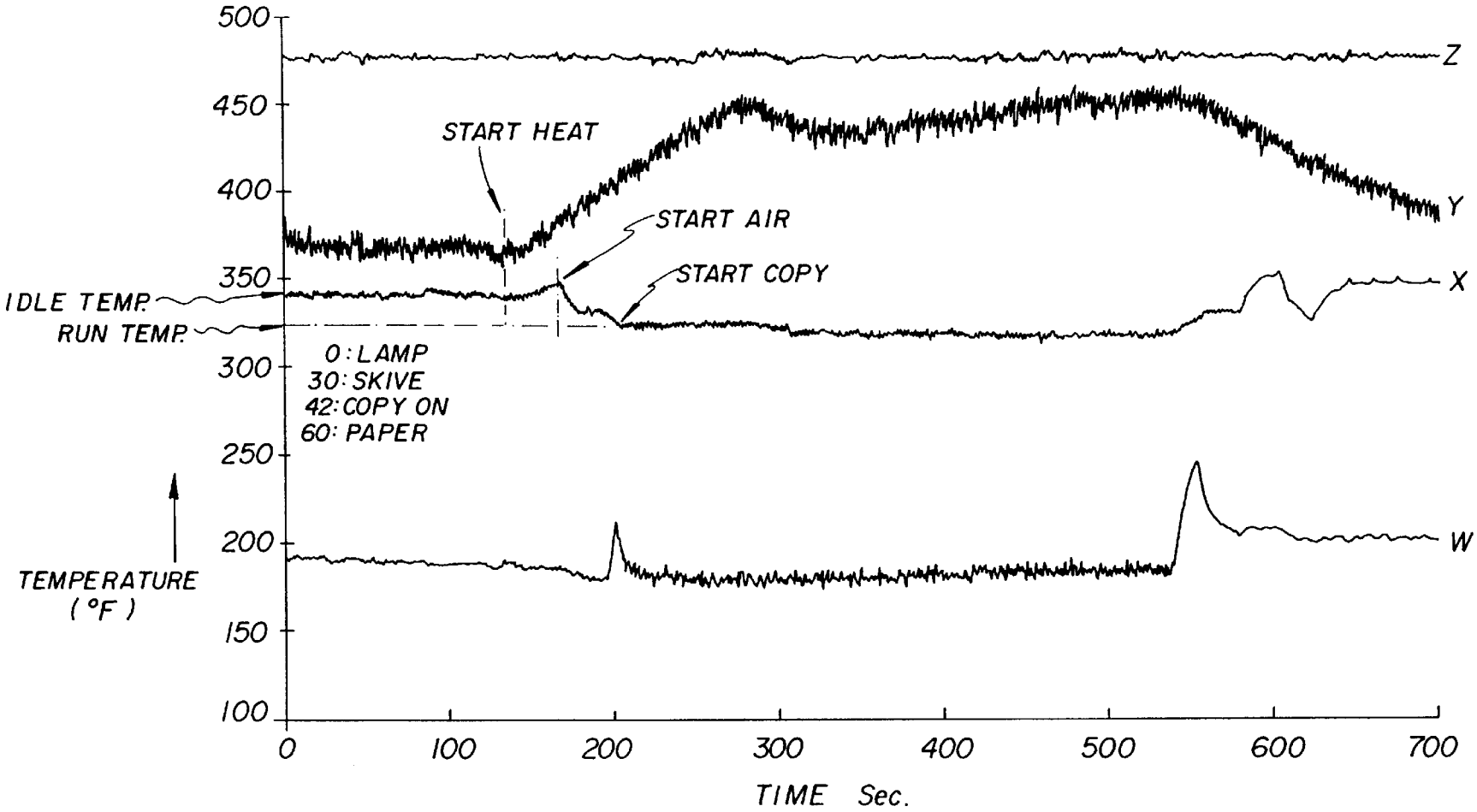
FIG. 3 is a graphical representation of reproduction apparatus fuser temperature responses when controlled according to this invention so as to prevent temperature droop and overshoot.

The control operation, according to this invention, substantially eliminates the temperature droop (and overshoot) in the fuser apparatus 10, as shown in the graph of FIG. 3. FIG. 3 shows temperature response profiles (designated respectively by the letters W, X, Y, and Z) for the pressure roller 14, fuser roller blanket outer surface 18, fuser roller core 16, and external heater roller 40 during the thermal droop period. Response X shows the temperature profile of the fuser roller 12, with the fuser roller temperature setpoint being at approximately 340° F., during the idle period, as compared to 320° F. during the reproduction job run. At the actuation of the reproduction apparatus job run start, the fuser temperature operating setpoint is raised to 350° F. so that the internal and external heat sources for the fuser roller 12 start supplying full heat to the fuser roller. After a preselected time (for example, 30 seconds), the air skives 30 are turned on to establish the desired air flow for creating the intended thermal gradient; and at a preselected time later (for example, 30 seconds), the first receiver member of the reproduction job run is allowed to enter the fusing nip. As seen in FIG. 3, there is substantially no droop observed in this case. During the reproduction job run, the air skives 30 are left on to function in the intended manner, that is so as to strip off any receiver member adhering to the fuser roller 12. Further, the air flow from the skives 30 is left on for preselected time after the last receiver member in the job run has passed through the fuser 10. As a result, the overshoot of the fuser roller temperature is also minimized.

The invention has been described in detail with particular reference to certain preferred embodiments thereof, but it will be understood that variations and modifications can be effected within the spirit and scope of the invention.

What is claimed is:

1. A fuser, for a reproduction apparatus, having at least one heated fuser roller operating at a setpoint temperature to permanently fix a marking particle image to a receiver member, and a mechanism for controlling temperature droop in said at least one heated fuser roller, said temperature droop controlling mechanism comprising:

an external heat source movable to a position in operative relation with said at least one heated fuser roller and a nonoperative position remote from said at least one heated fuser roller;

a source of pressurized air; and a logic and control unit for (1) regulating heat input to said at least one heated fuser roller, during an idle period, to maintain said at least one heated fuser roller at an idle temperature above the set point temperature;

(2) at the actuation of the reproduction apparatus job run start, regulating heat input to said at least one heated fuser roller to heat the fuser roller to a temperature above said idle temperature (3) after a preselected time, actuating said source of pressurized air direct air flow at said at least one heated fuser roller for creating an intended thermal gradient in said at least one heated fuser roller; and (4) at a preselected time later, enabling a first receiver member of a reproduction job run to be transported into operative relation with said at least one heated fuser roller, whereby there is substantially no temperature droop in said at least one heated fuser roller.

2. The temperature droop controlling mechanism according to claim 1 wherein said logic and control unit for actuating said pressurized air source maintains such air flow for a preselected time after a last receiver member in the reproduction job run has passed through said fuser, whereby overshoot of the temperature to which said fuser roller is heated is minimized.

3. The temperature droop controlling mechanism according to claim 2 wherein said pressurized air source includes a plurality of air skives directed at said at least one heated fuser roller.

4. The temperature droop controlling mechanism according to claim 3 wherein said plurality of air skives is maintained in an operative state during the reproduction job run so as to strip off any receiver member adhering to said at least one heated fuser roller.

5. A fuser, for a reproduction apparatus, for permanently fixing a marking particle image to such receiver member, said fuser comprising:

a fuser member having a heat source for heating said fuser member to an operating setpoint temperature;

an external heat source movable to a position in operative relation with said fuser member and a nonoperative position remote from said fuser member;

a source of pressurized air; and a logic and control unit for (1) regulating heat input to said fuser member, during an idle period, to maintain said fuser member at an idle temperature temperature above the setpoint temperature;

(2) at the actuation of the reproduction apparatus job run start, regulating heat input to said fuser member to heat the fuser roller to a temperature above said idle temperature (3) after a preselected time, actuating said source of pressurized air to direct air flow at said fuser member for creating an intended thermal gradient in said fuser member; and (4) at a preselected time later, enabling a first receiver member of a reproduction job run to be transported into operative relation with said fuser member, whereby there is substantially no temperature droop in said fuser member.

6. The reproduction apparatus fuser according to claim 5 wherein said fuser member is a roller.

7. The reproduction apparatus fuser according to claim 5 wherein said logic and control unit for actuating said pressurized air source maintains such air flow for a preselected time after a last receiver member in the reproduction job run has passed through said fuser, whereby overshoot of said fuser member temperature is minimized.

8. The reproduction apparatus fuser according to claim 7 wherein said pressurized air source includes a plurality of air skives directed at said fuser member.

9. The reproduction apparatus fuser according to claim 8 wherein said plurality of air skives is maintained in an operative state during the reproduction job run so as to strip off any receiver member adhering to said fuser member.

10. In a fuser, for a reproduction apparatus, having at least one heated fuser member operating at a setpoint temperature to permanently fix a marking particle image to a receiver member, a method for controlling temperature droop in said at least one heated fuser member, said temperature droop controlling method comprising the steps of:

regulating heat input to said at least one heated fuser member, during an idle period, to maintain said at least one heated fuser member at an idle temperature above the setpoint temperature;

at the actuation of the reproduction apparatus job run start, regulating heat input to said at least one heated fuser member to heat the at least one heated fuser member to a temperature above said idle temperature;

after a preselected time, actuating a source of air pressure to direct pressurized air flow at said at least one heated fuser member for creating an intended thermal gradient in said at least one heated fuser member; and at a preselected time later, enabling a first receiver member of a reproduction job run to be transported into operative relation with said at least one heated fuser member, whereby there is substantially no temperature droop in said at least one heated fuser member.

11. The temperature droop controlling method according to claim 10 wherein the pressurized air flow is maintained for a preselected time after a last receiver member in the reproduction job run has passed through said fuser.

12. The temperature droop controlling method according to claim 10 wherein said pressurized air flow is maintained in an state during the reproduction job run so as to strip off any receiver member adhering to said at least one heated fuser member.

* * * * *